United States Patent [19]

Desmond

[11] 3,951,330

[45] Apr. 20, 1976

[54] CARTON TOP CLOSURE ARRANGEMENT

[75] Inventor: John D. Desmond, Philadelphia, Pa.

[73] Assignee: Container Corporation of America, Chicago, Ill.

[22] Filed: Mar. 6, 1975

[21] Appl. No.: 555,971

[52] U.S. Cl. ..... 229/38; 229/87 R
[51] Int. Cl.[2] ..... B65D 5/08
[58] Field of Search ..... 229/87 R, 39 R, 38, 229/14 BL, 37 R, 44 R

[56] References Cited

UNITED STATES PATENTS

| | | | |
|---|---|---|---|
| 3,257,068 | 6/1966 | Wright | 229/87 R |
| 3,443,739 | 5/1969 | Adams, Jr. | 229/87 R X |
| 3,443,740 | 5/1969 | McKinney | 229/39 R |
| 3,451,611 | 6/1969 | Adams, Jr. | 229/37 R |
| 3,790,064 | 2/1974 | Kramer | 229/87 R X |
| 3,851,815 | 12/1974 | Desmond et al. | 229/37 R X |

*Primary Examiner*—Stephen P. Garbe
*Attorney, Agent, or Firm*—Carpenter, Ostis & Lindberg

[57] ABSTRACT

A top closure arrangement for a folding carton which includes a plurality of overlapped closure flaps, one of which includes a tuck tab, hingedly attached to its side edge for engagement with a projection on another closure flap for locking the flaps in a closed position.

5 Claims, 7 Drawing Figures

CARTON TOP CLOSURE ARRANGEMENT

BACKGROUND OF THE INVENTION

1. Field of the Invention

Figure 1:
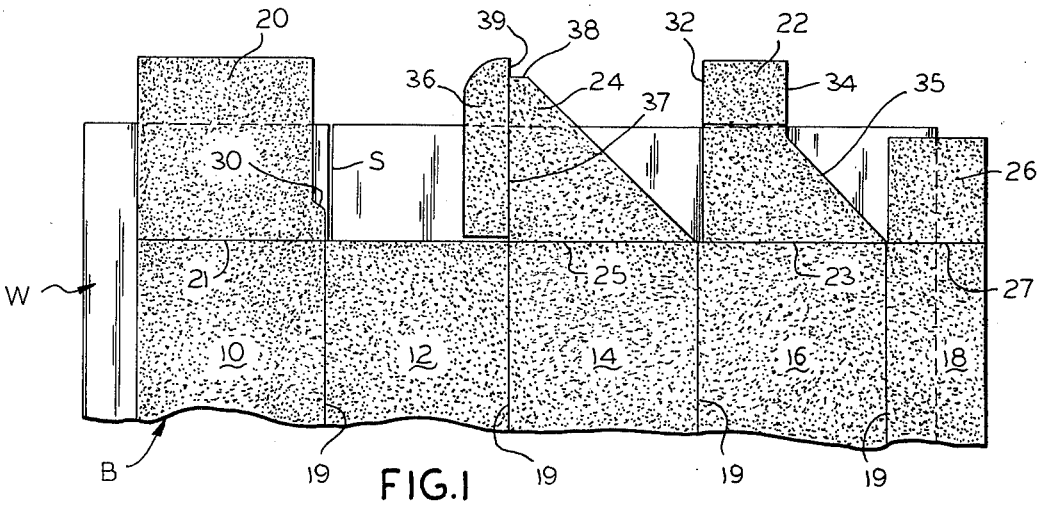

The invention relates to a top closure arrangement for a folding carton, and it is especially suitable for a pre-wrapped carton because it permits the carton to be closed on the same type of conventional closing equipment as may be used to close non-prewrapped cartons.

2. The Prior Art

The prior art is exemplified in the following United States patents developed in a recent search:

| | | | |
|---|---|---|---|
| Wright | 3,257,068 | June 21, 1966 | 229/87 |
| Desmond et al | 3,343,750 | September 26, 1967 | 229/87 |
| Adams, Jr. | 3,443,739 | May 13, 1969 | 229/39 |
| Adams, Jr. | 3,451,611 | June 24, 1969 | 229/37 |
| Adams, Jr. | 3,459,358 | August 5, 1969 | 229/37 |

The present invention provides a closure flap interlocking arrangement not disclosed in any of the prior art patents found in the search.

SUMMARY OF THE INVENTION

The invention is directed to a prewrapped carton formed from a blank of paperboard and having an overwrap attached to the outer surface of the blank, so that when the closure flaps are folded into overlapped position to close the end of the carton the visual effect will be that of a hand wrapped carton. A positive lock arrangement is provided by a tuck tab hinged to a side edge of one closure flap for engagement with an opposed closure flap.

THE DRAWING

FIG. 1 is a fragmentary plan view of a flat paperboard blank with an attached overwrap; and FIGS. 2 through 7 are fragmentary perspective views illustrating the upper portion of an erected carton, formed from the blank illustrated in FIG. 1, and shown in the various stages of the closing operation.

It will be understood that, for purposes of clarity, certain elements may have been intentionally omitted from certain views where they are believed to be illustrated to better advantage in other views.

Figure 2:
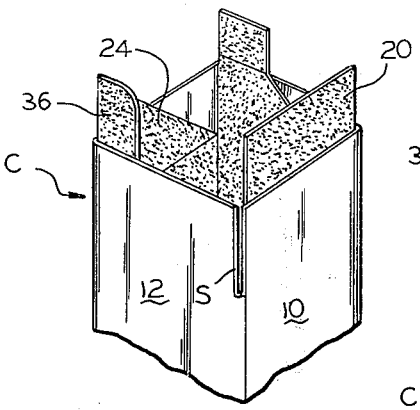
Figure 3:
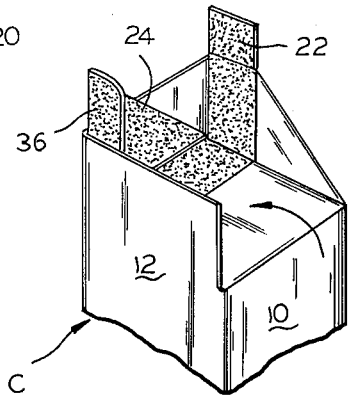

Referring now to the drawing for a better understanding of the invention, and particularly to FIGS. 1 and 2, it will be seen that the carton, embodying features of the invention and indicated generally at C in FIG. 2, may be formed from a unitary blank of paperboard, indicated generally at B in FIG. 1, which has secured to its outer surface a decorative sheet overwrap of flexible material such as paper film or the like and which is indicated generally at W.

It will be seen that the carton includes a plurality of side wall panels 10, 12, 14 and 16, and a glue panel 18, which are hingedly attached to each other along parallel vertical score lines 19, with the glue panel 18 being secured to the side wall panel 10 at the remote end of the blank to form a tubular structure open at the ends.

The closure arrangement for only one end of the carton is shown in the drawing. It will be understood that the closure arrangement at the opposite end of the carton may be the same as the illustrated arrangement or may be of a conventional automatic lock bottom construction which is well known to those familiar with the art.

As best seen in FIG. 1, first, second, and third top closure flaps and a glue panel extension 20, 22, 24, and 26 are hingedly attached to the upper edges of side wall panels 10, 14, 16, and glue panel 18 along collinear score lines 21, 23, 25, and 27, respectively.

First top closure flap 20 is of a generally rectangular configuration but has a portion of its side, adjacent side wall panel 12, cut away to provide a shoulder like projection 30 located at the base of the closure flap adjacent score line 21.

Second closure flap 22 is somewhat irregular in shape with its left side edge 32, as seen in FIG. 1, being straight and in general alignment with the score line 19 between side wall panels 14 and 16. The upper right portion of the flap has been cut away, so that its right side edge includes a vertical portion 34 extending downwardly from the upper edge of the flap, medially of the flap, toward a central area, and also a sloping portion 35 extending from the lower end of portion 34 to the lower right-hand corner of the flap in approximate alignment with the score line 19 between side wall panel 16 and glue panel 18.

Third top closure flap 24 is preferably generally triangular in shape and has a relatively narrow, elongated tuck tab 36 hingedly attached to its left side edge, as seen in FIG. 1, along a score line 37 which is actually an extension of the score line 19 between side wall panels 12 and 14. The free upper edge of the tuck tab may be rounded as desired to facilitate insertion of the tab into the carton in a manner hereinafter described.

Still referring to FIG. 1, it will be seen that the upper portion of third closure flap 24 has been cut away for a short distance as at 38, to expose and provide a locking edge or lip 39 at the outer end of tuck tab 36, which edge is in alignment with score line 37 interconnecting the tuck tab 36 and the third closure flap 24.

If desired, a glue panel extension 26 may be provided, and it is preferably generally rectangular and shorter than the top closure flaps. When the carton is glued to form a tubular structure, the glue panel extension 26 is secured to the face of first closure flap 20 at the same time the glue panel 18 is secured to the face of side wall panel 10.

It will be noted that the sheet overwrap W is secured to the outer surface of the carton blank B in such a manner that one side of the overwrap extends a slight distance beyond one side of the blank of paperboard, and the opposite side of the blank extends a slight distance beyond the opposite side of the overwrap. Also, the upper edge of the overwrap does not extend all the way to the top of the blank but extends only a little more than half way the length of the closure flaps. Further, it will be noted that the portion of the overwrap in the area of the closure flaps of the blank is uninterrupted except for one slit, indicated generally at S, which extends from the upper edge of the overwrap down to the area of the blank where the closure flaps are hinged thereto. Slit S is located immediately adjacent the projection 30 on first closure flap 20 and is in approximate alignment with score line 19 between side wall panels 10 and 12.

Figure 4:
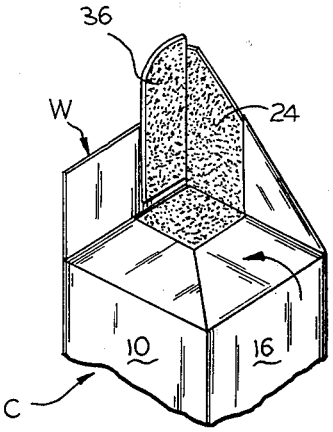
Figure 5:
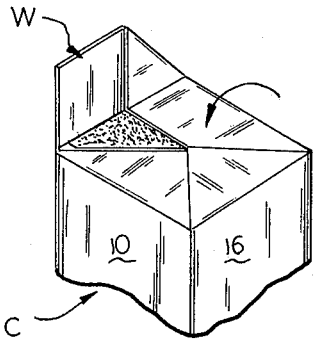
Figure 6:
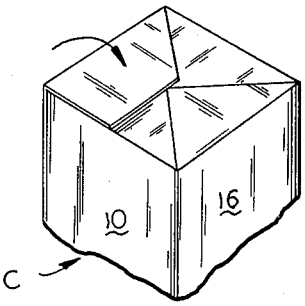
Figure 7:
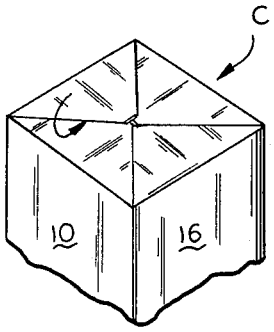

One of the primary advantages of the carton construction is that it does not require special machinery for closing, but even though it is a prewrapped carton, it may be formed on conventional closing equipment. The closure for the upper end of the carton is accomplished in the sequential arrangement illustrated in FIGS. 2 through 7. First, the first closure flap 20 is folded inwardly at right angles from its side wall panel 10 to the position shown in FIG. 3. Next, the second closure flap 22 is folded inwardly into overlapped relation with the first closure flap, as shown in FIG. 4. As this is done, it will be noted that the material of the overwrap lying between the first and second closure flaps is folded between the undersurface of the second closure flap and the upper surface of the first closure flap. Next, tuck tab 36 is folded inwardly so that it extends normal to third closure flap 24. Then the third closure flap 24 is folded inwardly so as to overlap the second closure flap. As this is done, tuck tab 36 is inserted into the carton between side wall panel 12 and the adjacent edge of first closure flap 20 with the locking edge or lip 39 of the tuck tab engaged under the shoulder like projection 30 of the first closure flap to lock the carton closure flaps in a closed position. At the same time, the material of the overwrap between the second and third flaps is folded therebetween, and the overwrap material extending upwardly from side wall panel 12 is folded back onto itself and under a portion of the third closure flap generally in the shape of an isosceles triangle, as best seen in FIGS. 5, 6, and 7. After this has been completed, a spot of glue (not shown) may be applied, or a decorative bow (not shown) may be attached to the top of the carton to give it the "gift wrap" appearance.

Although the carton construction of this invention is particularly suitable to prewrap cartons, it is to be understood that the novel closure flap arrangement involving the relationship between the locking lip of one closure flap tuck tab 36 and the shoulder like projection of another closure flap 20 provides a unique and simple manner of locking closure flaps on tubular folding cartons.

I claim:

1. In a closure arrangement for a prewrapped, collapsible carton formed from a unitary blank of foldable paperboard having a sheet overwrap of flexible material such as paper, film, or the like secured to its outer surface, the combination of:

a. first, second, third, and fourth side wall panels hingedly interconnected to form a tubular structure open at the top;

b. first, second, and third top closure flaps hingedly attached to the upper edges of said first, second, and third side wall panels, respectively;

c. said first flap presenting at a side thereof adjacent said fourth side wall panel a shoulder like projection located adjacent the side wall panel to which said first flap is connected;

d. said third flap having hingedly attached thereto, at a side thereof adjacent said fourth side wall panel a relatively narrow, elongated tuck tab having a tip projecting a slight distance beyond an edge of said third flap remote from the side wall panel to which said third flap is connected;

e. said sheet of overwrap extending approximately one half of the length of the closure flaps and being uninterrupted throughout its width except for a slit located adjacent the projection on said first flap and extending from an edge of said fourth side wall panel to the free edge of said overwrap;

f. said closure flaps being adapted to be folded over into overlapped relation with each other with said tuck tab being inserted between an inner surface of said fourth side wall panel and an adjacent edge of said first closure flap and with the tip of said tuck tab engaged under said first closure flap projection, whereby excess portions of said overwrap in the areas between certain adjacent edges of said closure flaps are folded under related closure flaps.

2. In a closure arrangement for a prewrapped, collapsible carton formed from a unitary blank of foldable paperboard having a sheet overwrap of flexible material such as paper, film, or the like secured to its outer surface, the combination of:

a. first, second, third, and fourth side wall panels hingedly interconnected to form a tubular structure open at the top;

b. first, second, and third top closure flaps hingedly attached to the upper edges of said first, second and third side wall panels, respectively;

c. said first flap presenting at a side thereof adjacent said fourth side wall panel a shoulder like projection located adjacent the side wall panel to which said first flap is connected;

d. said third flap having hingedly attached thereto, at a side thereof adjacent said fourth side wall panel a relatively narrow, elongated tuck tab having a tip projecting a slight distance beyond an edge of said third flap remote from the side wall panel to which said third flap is connected;

e. said closure flaps being adapted to be folded over into overlapped relation with each other with said tuck tab being inserted between an inner surface of said fourth side wall panel and an adjacent edge of said first closure flap and with the tip of said tuck tab engaged under said first closure flap projection, whereby excess portions of said overwrap in the areas between certain adjacent edges of said closure flaps are folded under related closure flaps.

3. In a closure arrangement for a prewrapped, collapsible carton formed from a unitary blank of foldable paperboard having a sheet overwrap of flexible material such as paper, film, or the like secured to its outer surface, the combination of:

a. first, second, third, and fourth side wall panels hingedly interconnected to form a tubular structure open at the top;

b. first, second, and third top closure flaps hingedly attached to the upper edges of said first, second, and third side wall panels, respectively;

c. said first flap presenting at one side thereof a shoulder like projection;

d. said third flap having hingedly attached thereto, at one side thereof, a relatively narrow, elongated tuck tab;

e. said sheet of overwrap extending approximately one-half of the length of the closure flaps and being uninterrupted throughout its width except for a slit located adjacent the projection on said first flap and extending from an edge of said fourth side wall panel to the free edge of said overwrap;

f. said closure flaps being adapted to be folded over into overlapped relation with each other with said tuck tab being inserted between an inner surface of said fourth side wall panel and an adjacent edge of said first closure flap and with the tip of said tuck tab engaged under said first closure flap projection, whereby excess portions of said overwrap in the areas between certain adjacent edges of said closure flaps are folded under related closure flaps.

4. In a closure arrangement for a prewrapped, collapsible carton formed from a unitary blank of foldable paperboard, the combination of:

a. first, second, third, and fourth side wall panels hingedly interconnected to form a tubular structure open at the top;

b. first, second, and third top closure flaps hingedly attached to the upper edges of said first, second, and third side wall panels, respectively;

c. said first flap presenting at a side thereof adjacent said fourth side wall panel a shoulder like projection located adjacent the side wall panel to which said first flap is connected;

d. said third flap having hingedly attached thereto, at a side thereof adjacent said fourth side wall panel a relatively narrow, elongated tuck tab having a tip projecting a slight distance beyond an edge of said third flap remote from the side wall panel to which said third flap is connected;

e. said closure flaps being adapted to be folded over into overlapped relation with each other with said tuck tab being inserted between an inner surface of said fourth side wall panel and an adjacent edge of said first closure flap and with the tip of said tuck tab engaged under said first closure flap projection.

5. In a closure arrangement for a collapsible carton formed from a unitary blank of foldable paperboard, the combination of:

a. first and second pairs of opposed side wall panels hingedly interconnected to form a tubular structure open at the top;

b. outer and inner top closure flaps hingedly attached to the upper edges of said first pair of side wall panels;

c. said outer flap presenting at a side thereof adjacent one side wall panel of said second pair a shoulder-like projection located adjacent the side wall panel to which said outer flap is connected;

d. said inner flap having hingedly attached thereto, at a side thereof adjacent said one side wall a relatively narrow, elongated tuck tab having a tip projecting a slight distance beyond an edge of said inner flap remote from the side wall panel to which said inner flap is attached;

e. said closure flaps being adapted to be folded over into overlapped relation with said tuck tab being inserted between an inner surface of said one side wall panel and an adjacent edge of said inner closure flap and with the tip of said tab being engaged under the projection of said inner closure flap.

* * * * *